US008324842B2

(12) United States Patent
Gasser

(10) Patent No.: US 8,324,842 B2
(45) Date of Patent: Dec. 4, 2012

(54) FURNITURE DRIVE WITH A DRIVE UNIT

(75) Inventor: Ingo Gasser, Höchst (AT)

(73) Assignee: Julius Blum GmbH, Hochst (AT)

( * ) Notice: Subject to any disclaimer, the term of this patent is extended or adjusted under 35 U.S.C. 154(b) by 61 days.

(21) Appl. No.: 12/871,065

(22) Filed: Aug. 30, 2010

(65) Prior Publication Data

US 2011/0050061 A1 Mar. 3, 2011

Related U.S. Application Data

(63) Continuation of application No. PCT/AT2009/000065, filed on Feb. 19, 2009.

(30) Foreign Application Priority Data

Mar. 7, 2008 (AT) ..... A 378/2008

(51) Int. Cl.
*A47B 88/04* (2006.01)
*A47B 95/00* (2006.01)

(52) U.S. Cl. ..... 318/14; 318/15

(58) Field of Classification Search ..... 318/6, 9–15, 318/575–578, 626, 264–266, 272, 275, 277, 318/282, 286, 466–469
See application file for complete search history.

(56) References Cited

U.S. PATENT DOCUMENTS

| | | | | |
|---|---|---|---|---|
| 4,711,564 | A * | 12/1987 | Mugrauer et al. | 355/30 |
| 4,832,186 | A * | 5/1989 | Conrad | 198/840 |
| 5,226,867 | A * | 7/1993 | Beal | 482/127 |
| 5,319,880 | A * | 6/1994 | Kuhlman | 49/360 |
| 5,618,262 | A * | 4/1997 | Rene | 601/116 |
| 2003/0221370 | A1 | 12/2003 | Nakano | |
| 2004/0100169 | A1 | 5/2004 | Huber et al. | |
| 2006/0130713 | A1 | 6/2006 | Jones et al. | |
| 2008/0115417 | A1 * | 5/2008 | Huber | 49/349 |

FOREIGN PATENT DOCUMENTS

| | | |
|---|---|---|
| CN | 2667968 | 1/2005 |
| DE | 1 170 124 | 5/1964 |
| DE | 1 554 360 | 11/1969 |
| DE | 28 49 707 | 5/1980 |
| DE | 20 2006 003 901 | 8/2007 |
| EP | 1 374 732 | 1/2004 |
| WO | 01/16451 | 3/2001 |
| WO | 2007/009133 | 1/2007 |
| WO | 2007/147180 | 12/2007 |

OTHER PUBLICATIONS

International Search Report issued Jun. 22, 2009 in International (PCT) Application No. PCT/AT2009/000065.

Austrian Patent Office Search Report completed Nov. 6, 2008 in Austrian Patent Application No. A378/2008.

* cited by examiner

*Primary Examiner* — Bentsu Ro

(74) *Attorney, Agent, or Firm* — Wenderoth, Lind & Ponack, L.L.P.

(57) ABSTRACT

A furniture drive has a drive unit including an electric motor and a roller that is rotatable about an axis, the roller having a surface for attaching or winding up a flexible force transmission member. The radial distance of the surface changes in the rotational direction of the roller for forming at least one control cam for the force transmission member.

49 Claims, 6 Drawing Sheets

FURNITURE DRIVE WITH A DRIVE UNIT

This application is a Continuation of International application PCT/AT2009/000065, filed Feb. 19, 2009, the entire disclosure of which is incorporated herein by reference.

BACKGROUND OF THE INVENTION

The present invention concerns a furniture drive comprising a drive unit which has an electric motor and a roller which is rotatable about an axis, wherein the roller has a surface for applying or winding up a flexible force transmission means.

Furniture drives with electric motors are already part of the state of the art. Thus, for example, WO 2007/147180 discloses a pull-in device for a drawer, wherein an electric motor rotates a roller by way of a drive unit and in so doing winds a pulling means on to the roller, whereby the drawer connected to the pulling means is pulled in the closing direction. A disadvantage of furniture drives of the general kind set forth is that the electric motors used can only provide the full torque, as from a certain rotary speed. That leads to problems when starting up and decelerating furniture parts, for example drawers, by means of a furniture drive of the general kind set forth.

The object of the invention is to provide a furniture drive having a simple device with which starting and deceleration of furniture parts moved with the furniture drive is facilitated.

That object is attained by a furniture drive having the features of the present invention. By virtue of a variable radial spacing in the direction of rotation of the surface of the roller, on to which a flexible force transmission means is applied or wound, a control cam is provided for the force transmission means. By virtue of that control cam, it is possible to targetedly control the necessary torque that the furniture drive must apply by way of the force transmission means for moving the furniture part. If, for example, the radial spacing of the surface and thus the radial spacing of the control cam is slight, the torque to be applied is also low. In that way, the electric motor can more rapidly provide its optimum rotary speed and thus its full torque.

In a particularly preferred embodiment of the invention, the roller itself is driven by the electric motor. Due to the above-specified measure, a lower torque is initially necessary to move the furniture part, whereby generally the motor power or the size of the motor of the furniture drive can be reduced.

It is particularly advantageous for the control cam to be designed in such a way that, at the beginning of the movement, the radial spacing of the control cam relative to the axis of rotation is kept at a minimum and then slowly increases until it reaches a maximum radial spacing. That measure means that the motor can more quickly reach its optimum rotary speed. In addition, it may be advantageous that, in the further configuration of the control cam, by way of which the force transmission means is caused to bear against or is wound on to a surface, the radial spacing relative to the axis of rotation of the roller is kept constant. It can be provided in that respect that the winding length corresponds to the length of the force transmission means, for example a cable or belt.

Particularly advantageous configurations for the control cam, are for example, spiral control cams, where the rate of increase in the radial spacing is constant, eccentric control cams, or the like.

In an embodiment of the invention, the rate of increase at which the radial spacing changes in the configuration of the control cam can be not constant, in contrast to a spiral control cam. It can be advantageous in that respect that the rate of increase in the radial spacing is particularly great at the beginning of the control cam, and then decreases in the further course of the control cam. It can, however, also be provided that the rate of increase in the radial spacing of the control cam increases in the course of the control cam or that the radial spacing at the beginning of the control cam has a low rate of increase, then increases more greatly in the further course of the control cam and again has lower rates of increase in a subsequent region of the control cam.

A particularly preferred embodiment of the invention provides that the radial spacing of the control cam in a first region increases from a minimum value to a maximum value and remains constant in a second region following the first region. That complies with the construction of a furniture drive according to the invention, especially as torque control is necessary only at the beginning of a change in motion (that is to say, for starting and decelerating the furniture part), while for the major part of the movement the constant torque that is prevailing after the attainment of a certain rotary speed of the electric motor is fully sufficient. In addition, such a control cam with a second region involving a constant radial spacing can avoid the roller which is rotatable about an axis becoming too large and no longer being suitable for installation in a furniture carcass.

In a preferred embodiment of the invention, that control cam is formed at an end of the roller. It can, however, also be possible for the control cam to be provided at the peripheral surface of the roller. That is the case, in particular, when the force transmission means is not wound around the roller a plurality of times.

As when starting the movement, when a furniture part to be moved has to be accelerated, major forces are also necessary when decelerating a moving furniture part. Therefore, at least one second control cam separate from the first can be provided on the roller. In that respect, the second control cam can have an opposite configuration to the first control cam. That is the case, for example, when the control cam is provided by the radial spacing of the surface, at which the force transmission means is applied or wound on, decreasing from a maximum value to a minimum value. In that case, during a motion of the furniture part in one direction, the force transmission means can be wound on or applied at a first control cam while it is unwound or removed at a second control cam. In that respect, less torque is necessary initially in the starting procedure by the first control cam while upon deceleration of the furniture part more force is made available by the second control cam. In other words, support in acceleration occurs at the first control cam at the beginning of the motion of the furniture part, which makes it easier for the electric motor. At the other control cam, there is support for deceleration towards the end of the motion of the furniture part, so a damping action is involved. In a motion in the reverse direction, that support in respect of deceleration and acceleration takes place at the respective other control cam.

It may be advantageous in that respect for the two control cams to be provided at the same end or at the opposite ends of the roller. It may be provided that a mutually opposite control cam is provided on both ends of the roller. On the other hand, it may also be advantageous to provide the same control cams at both ends, that is to say for example two respective mutually opposite control cams. The advantage of this is that the arrangement of the ends is immaterial, when fitting the roller.

In a further embodiment, control cams involving different torque configurations are implemented at the two opposite ends. In that case, two mutually opposite control cams can be arranged for example at each end. The control cams which are arranged at the two ends can differ in their rate of increase in the radial spacing from the axis of rotation of the roller.

As already mentioned, the force transmission means can be implemented by a cable or a belt. The force transmission means can be fixed with at least one end to the roller. The force transmission means can also be fixed with two ends to the roller. That is particularly advantageous in the case of two mutually opposite control cams. During start-up, the force transmission means is rolled on from its first end and unrolled from its second end.

Further advantageous configurations of the invention are described below.

BRIEF DESCRIPTION OF THE DRAWINGS

Further advantages and details will be apparent from the Figures and the accompanying specific description. In the Figures.

DETAILED DESCRIPTION OF THE INVENTION

Figure 1B:
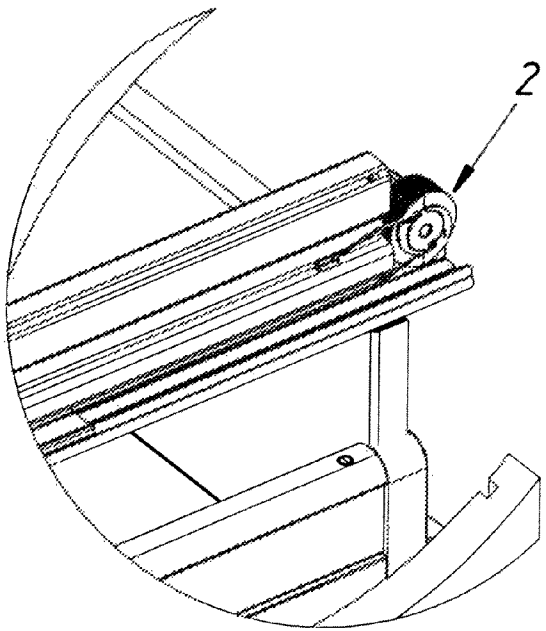
FIGS. 1*a* and 1*b* show a furniture carcass according to the invention with a furniture drive and a detail view of the furniture drive.
Figure 1A:
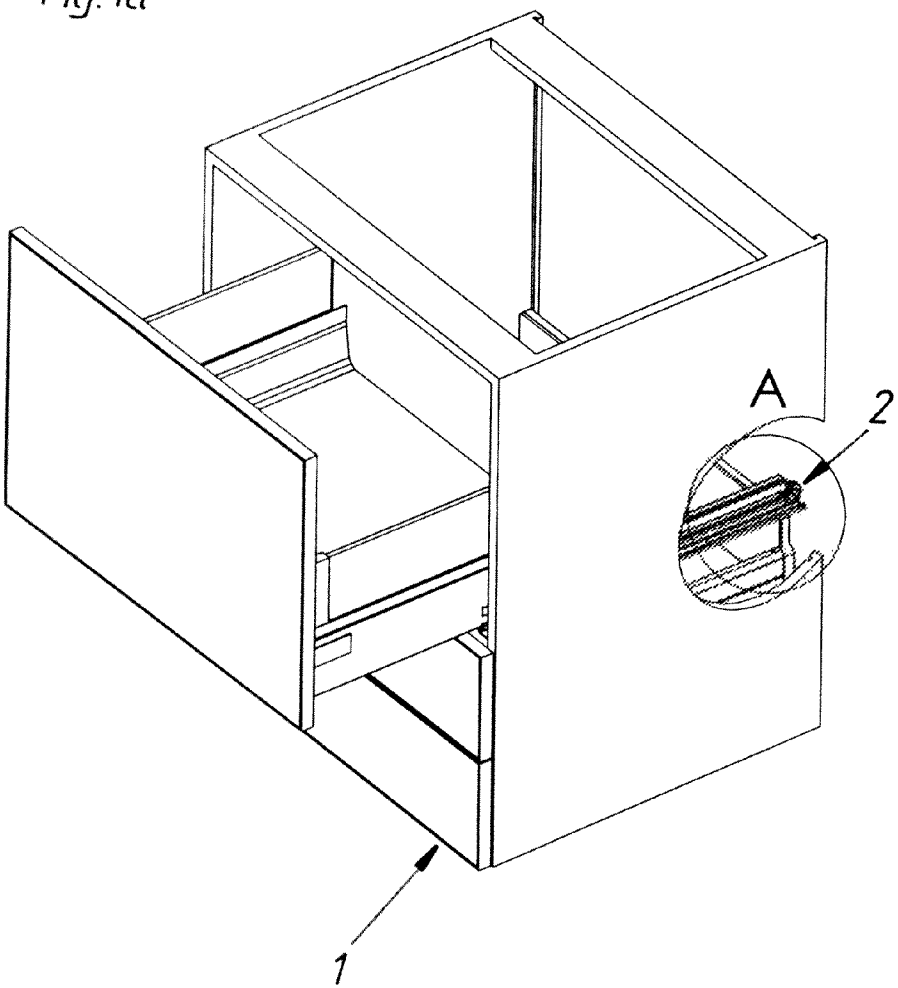

It will be presupposed that both opening and closing of the movable furniture part (for example flap of an article of furniture or a drawer) is possible with a furniture drive according to the invention. In the illustrated embodiment, that is achieved by a reversible electric motor. FIG. 1*a* shows an embodiment of a furniture carcass 1 according to the invention. In this case, a drawer is moved open and shut by a furniture drive 2 according to the invention. FIG. 1*b* shows a detail view on an enlarged scale of the portion marked by A, illustrating the furniture drive 2 according to the invention.

Figure 2:
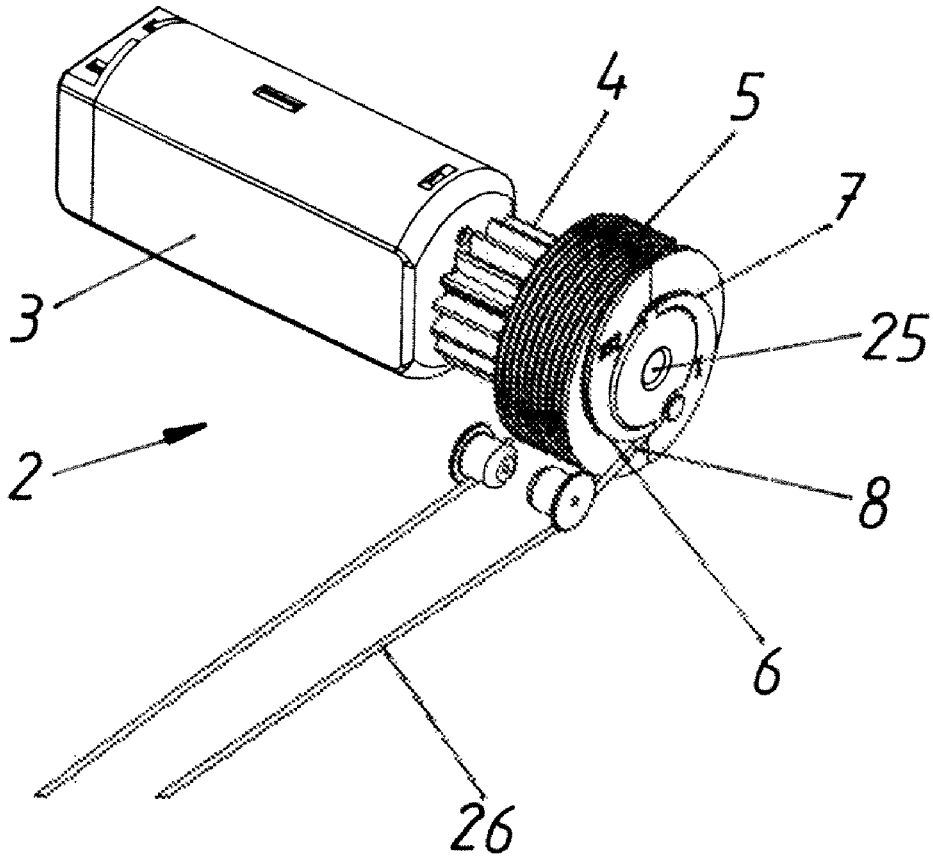
FIG. 2 shows an embodiment of a furniture drive according to the invention.

FIG. 2 shows a view of an embodiment of a furniture drive according to the invention. In this case, a roller 5 is driven by an electric motor 3 by way of a drive shaft (not shown) on which a gear 4 is carried. The roller 5 has a surface on which a force transmission member (which in this embodiment is provided by a cable line 26 having a first cable end 8) is wound or applied. The first end 8 of the cable 26 is fixed on a first axial end of the roller 5. Provided on that axial end of the roller 5 are two control cams 6, 7, each in the form of a spiral. In the embodiment illustrated here, the cable 26 is wound on and unwound along the control cam 6. A second end 9 of the cable 26 is fixed to the opposite (second) axial end of rollers. One or more control cams can also be provided at the second axial end that is closer to the electric motor 3. For example, the same control cams can be provided on both ends so that it is immaterial how the ends of the roller 5 are arranged on the drive shaft. It can, however, also be provided that control cams of different configurations are provided at the two ends to embody different torque configurations.

Figure 3:
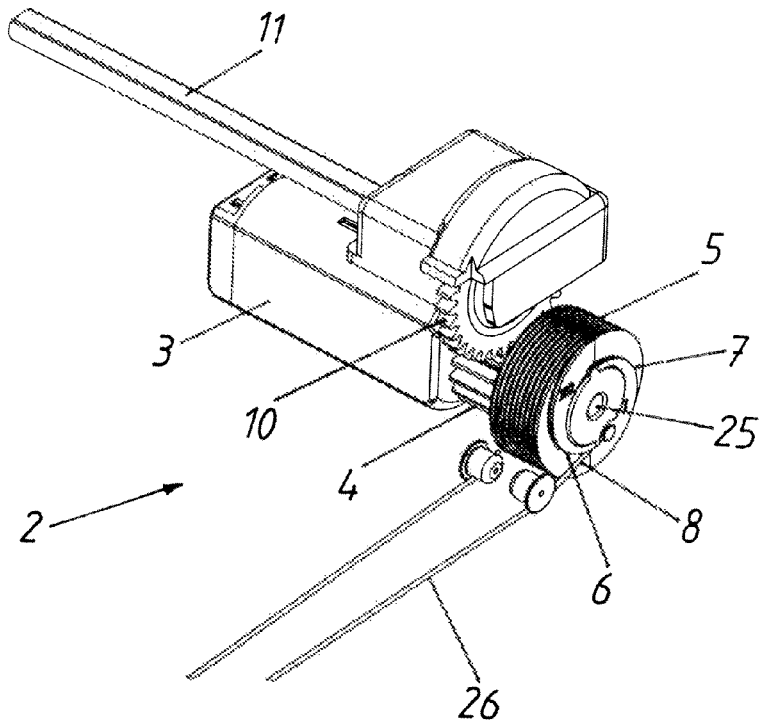
FIG. 3 shows an embodiment of a furniture drive according to the invention with a device for synchronization of the drive of the two central rails.

FIG. 3 shows the same embodiment of a furniture drive according to the invention. The electric motor 3 drives a first central rail (not shown here) by way of the cable line 26. The drive of a second central rail (also not shown here) is synchronised by way of a gear 10 and a shaft 11. A second electric motor can be synchronised by that shaft or a second central rail can be driven directly by way of that shaft 11 and possibly additional gears and a further flexible force transmission member, for example a further cable line.

Figure 4A:
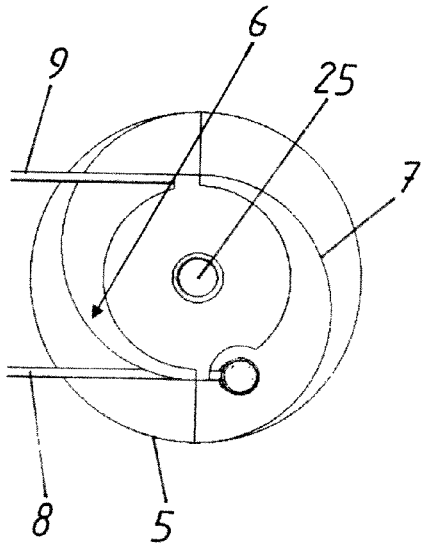
FIGS. 4*a* and 4*b* show a view of embodiments of control cams on a roller.
Figure 4B:
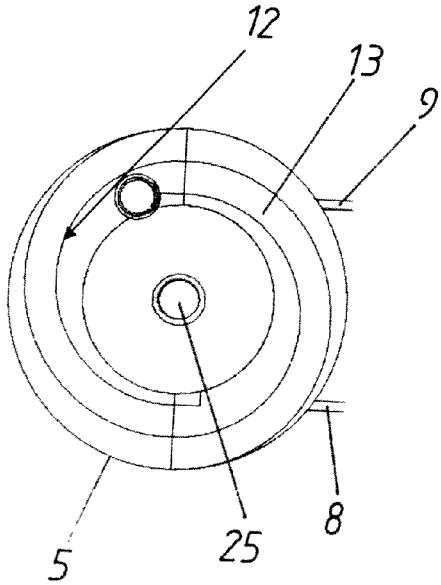

FIGS. 4*a* and 4*b* show embodiments of control cams 6, 7 on the roller 5. In this case, FIG. 4*a* shows the first axial end of the roller 5. In this embodiment, both cable ends 8, 9 are fixed at that first end and are rolled on and off the control cams 6, 7 which are each in the form of a spiral. In this example, the cable line 26 is rolled on along the first control cam 6 from the cable end 8 in the opening movement, for example of a drawer, whereby a lower torque is required by virtue of the initially smaller radial spacing relative to the axis of rotation 25 of the roller 5. During the rolling-on process, that radial spacing increases in order then to reach the maximum value when the electric motor operates at a higher rotary speed. At the same time, the second cable end 9 is unrolled at the second control cam 7. In that respect, the transition into the region of the variable radial spacing involves a damping action, in the above-mentioned example, resulting in damping of the opening movement of the drawer. When the furniture part, for example a drawer, is closed again, the second cable end 9 is rolled on along the second control cam 7. In that case, the reverse effects occur, that is to say when starting from the open condition of the furniture part, a lower level of torque is required by virtue of the smaller radial spacing relative to the axis of rotation 25 and in the process of the first cable end 8 being unrolled on the first control cam 6, a damping action is produced, that is to say an opening damping action. FIG. 4*b* shows the opposite (second) end of the roller 5. In this case, the Figure shows two other spiral control cams 12, 13 which have a lower rate of increase. In that way it is possible to implement a different torque configuration by re-fitting the roller 5 whereby the ends of the roller 5 are arranged in reversed relationship on the drive shaft.

Figure 5A:
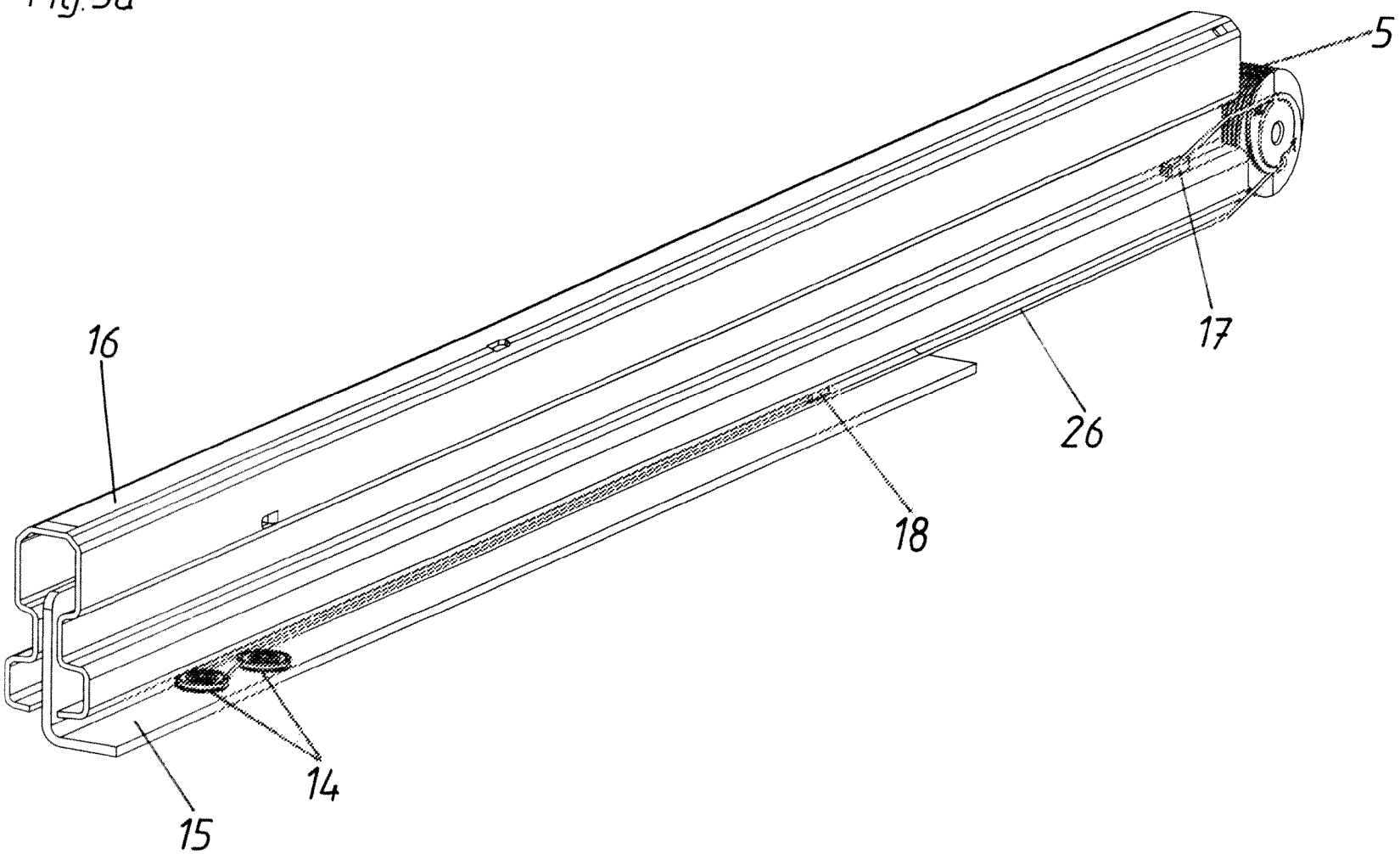
FIGS. 5*a* through 5*c* show a perspective view of an embodiment of a furniture drive according to the invention, and separated details thereof.
Figure 5B:
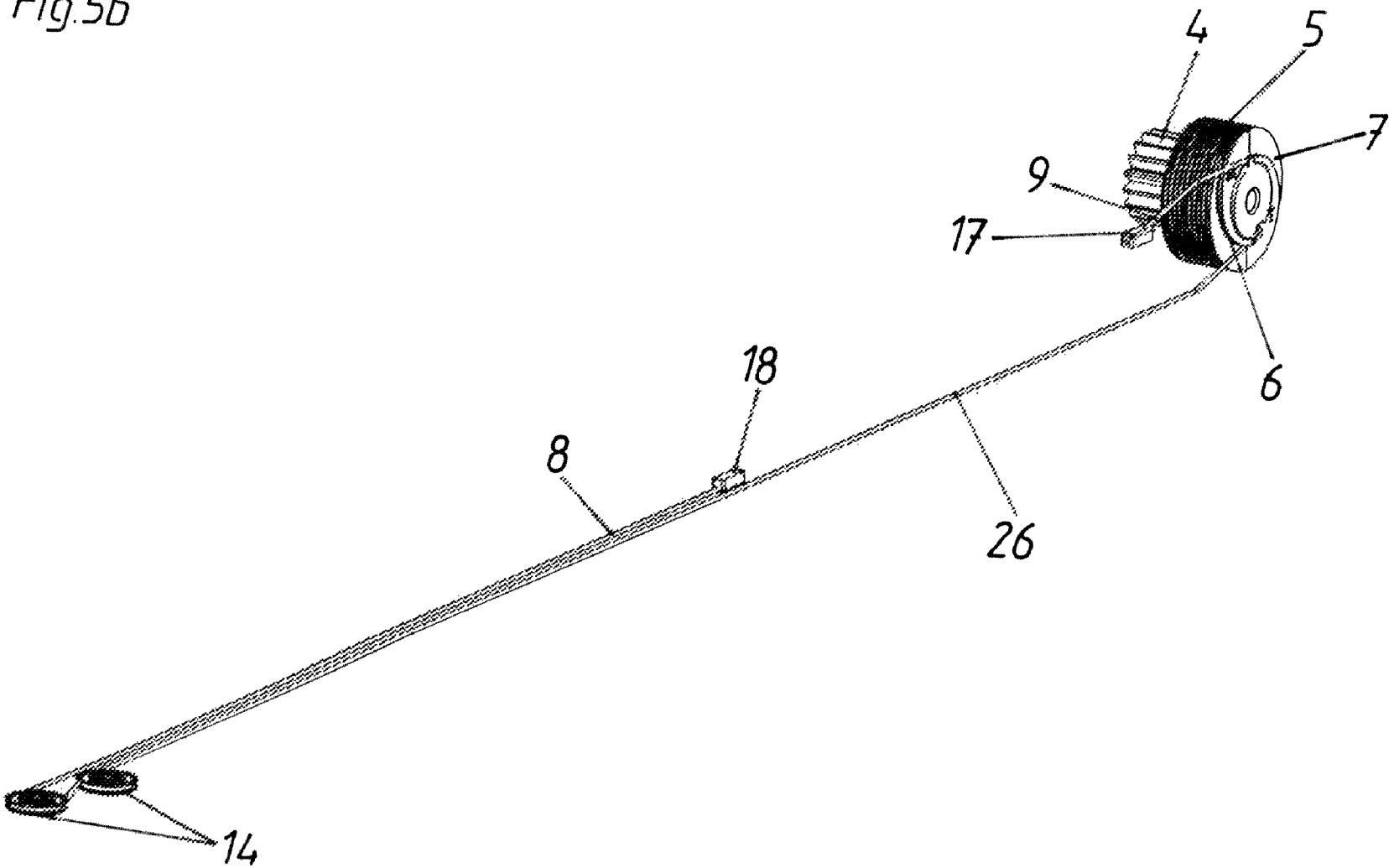
Figure 5C:
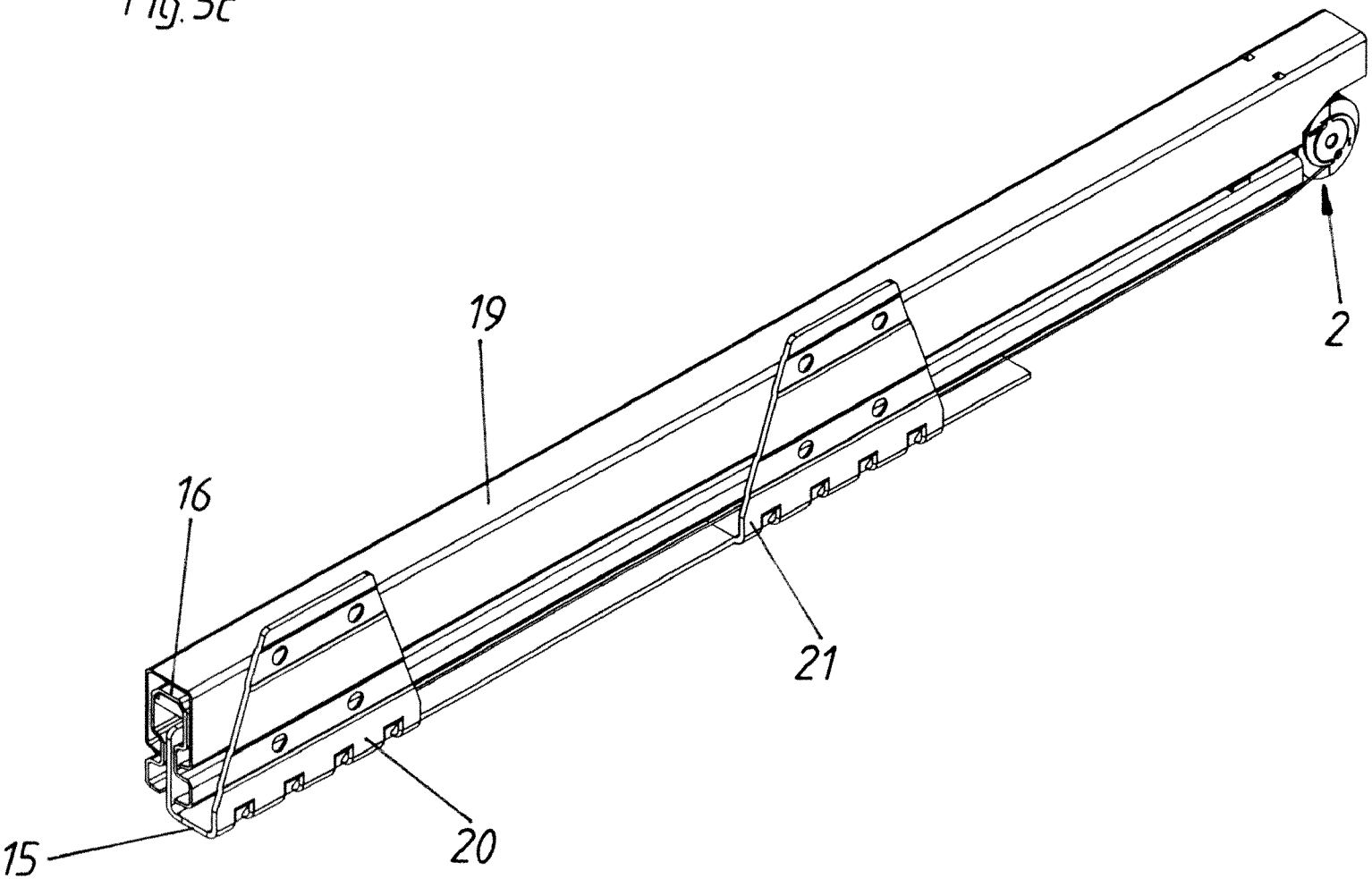

FIGS. 5*a* through 5*c* show the perspective view of a furniture drive according to the invention, together with a possible embodiment of the fixing thereof. In this case, the two cable ends 8, 9 of a cable line 26 are fixed to the central rail 16 by way of two attachment members 17, 18. The cable line 26 can also be in the form of an endless cable. As can be seen from the detail view in FIG. 5*b* in this case, the cable line 26 passes over two direction-changing rollers 14. FIG. 5*c* additionally shows two fixing lugs 20, 21 for the carcass rail 15 and the drawer rail 19. The central rail 16 and the drawer rail 19 are connected together in a known manner by a positive control system so that a movement of the central rail 16 results in a corresponding movement of the drawer rail 19. The central rail 16 itself is driven by way of the attachment members 17 and 18, and the cable line 26 connects the central rail 16 to the roller 5 by way of the control cams 6, 7.

It will be appreciated that the furniture drive according to the invention is not limited to the embodiments illustrated in the Figures nor is it intended to be restricted thereby.

The invention claimed is:

1. A furniture drive comprising:

a drive unit including an electric motor and a roller rotatable about an axis, said roller having a surface for winding up a flexible force transmission member;

wherein said roller is configured to change a radial spacing of said surface in a direction of rotation of said roller to form a control cam for said force transmission member.

2. The furniture drive of claim 1, wherein said roller is driven by said electric motor.

3. The furniture drive of claim 1, wherein said radial spacing of said surface increases from a first region having minimum radial spacing to a second region having a maximum radial spacing.

4. The furniture drive of claim 3, wherein said control cam has an at least partially spiral configuration.

5. The furniture drive of claim 3, wherein said roller is configured to change, during a course of operation of said control cam, a rate at which said radial spacing of said surface increases.

6. The furniture drive of claim 3, wherein said roller is configured so that said radial spacing of said surface increases in a first region from a minimum value to a maximum value, and so that said radial spacing remains substantially constant in a second region following said first region.

7. The furniture drive of claim 1, wherein said roller is configured so that said radial spacing of said surface increases in a first region from a minimum value to a maximum value and so that said radial spacing remains substantially constant in a second region following said first region.

8. The furniture drive of claim 1, wherein said control cam is located at a peripheral axial surface of said roller.

9. The furniture drive of claim 1, wherein said control cam comprises a first control cam, said roller having two separate control cams including said first control cam and a second control cam.

10. The furniture drive of claim 9, wherein said radial spacing of said two separate control cams changes in opposite relationship.

11. The furniture drive of claim 9, wherein said two separate control cams are located at opposite axial ends of said roller.

12. The furniture drive of claim 1, wherein said force transmission member comprises one of a cable and a belt, said one of a cable and a belt having at least one end fixed to said roller.

13. A drawer extension guide comprising:

a carcass rail;

a drawer rail; and said furniture drive of claim 1 for driving at least one of said carcass rail and said drawer rail.

14. A furniture drive comprising:

a drive unit including an electric motor and a roller rotatable about an axis, said roller having a surface for applying or winding up a flexible force transmission member;

wherein said roller is configured to change a radial spacing of said surface in a direction of rotation of said roller to form a control cam for said force transmission member, said control cam having an at least partially spiral configuration.

15. The furniture drive of claim 14, wherein said roller is driven by said electric motor.

16. The furniture drive of claim 14, wherein said radial spacing of said surface increases from a first region having a minimum radial spacing to a second region having a maximum radial spacing.

17. The furniture drive of claim 16, wherein said roller is configured to change, during a course of operation of said control cam, a rate at which said radial spacing of said surface increases.

18. The furniture drive of claim 16, wherein said roller is configured so that said radial spacing of said surface increases in a first region from a minimum value to a maximum value, and so that said radial spacing remains substantially constant in a second region following said first region.

19. The furniture drive of claim 14, wherein said roller is configured so that said radial spacing of said surface increases in a first region from a minimum value to a maximum value, and so that said radial spacing remains substantially constant in a second region following said first region.

20. The furniture drive of claim 14, wherein said control cam is located at a peripheral axial surface of said roller.

21. The furniture drive of claim 14, wherein said control cam comprises a first control cam, said roller having two separate control cams including said first control cam and a second control cam.

22. The furniture drive of claim 21, wherein said radial spacing of said two separate control cams changes in opposite relationship.

23. The furniture drive of claim 21, wherein said two separate control cams are located at opposite axial ends of said roller.

24. The furniture drive of claim 14, wherein said force transmission member comprises one of a cable and a belt, said one of a cable and a belt having at least one end fixed to said roller.

25. A drawer extension guide comprising:

a carcass rail;

a drawer rail; and said furniture drive of claim 14 for driving at least one of said carcass rail and said drawer rail.

26. A furniture drive comprising:

a drive unit including an electric motor and a roller rotatable about an axis, said roller having a surface for applying or winding up a flexible force transmission member;

wherein said roller is configured to change a radial spacing of said surface in a direction of rotation of said roller to form a control cam for said force transmission member; and wherein said roller is configured so that said radial spacing of said surface increases in a first region from a minimum value to a maximum value and so that said radial spacing remains substantially constant in a second region following said first region.

27. The furniture drive of claim 26, wherein said roller is driven by said electric motor.

28. The furniture drive of claim 26, wherein said radial spacing of said surface increases from a first region having a minimum radial spacing to a second region having a maximum radial spacing.

29. The furniture drive of claim 28, wherein said control cam has an at least partially spiral configuration.

30. The furniture drive of claim 28, wherein said roller is configured to change, during a course of operation of said control cam, a rate at which said radial spacing of said surface increases.

31. The furniture drive of claim 26, wherein said control cam is located at a peripheral axial surface of said roller.

32. The furniture drive of claim 26, wherein said control cam comprises a first control cam, said roller having two separate control cams including said first control cam and a second control cam.

33. The furniture drive of claim 32, wherein said radial spacing of said two separate control cams changes in opposite relationship.

34. The furniture drive of claim 32, wherein said two separate control cams are located at opposite axial ends of said roller.

35. The furniture drive of claim 26, wherein said force transmission member comprises one of a cable and a belt, said one of a cable and a belt having at least one end fixed to said roller.

36. A drawer extension guide comprising:

a carcass rail;

a drawer rail; and said furniture drive of claim 26 for driving at least one of said carcass rail and said drawer rail.

37. A furniture drive comprising:

a drive unit including an electric motor and a roller rotatable about an axis, said roller having a surface for applying or winding up a flexible force transmission member;

wherein said roller is configured to change a radial spacing of said surface in a direction of rotation of said roller to form a control cam for said force transmission member; and wherein said force transmission member has at least one end fixed to said roller.

38. The furniture drive of claim 37, wherein said roller is driven by said electric motor.

39. The furniture drive of claim 37, wherein said radial spacing of said surface increases from a first region having minimum radial spacing to a second region having a maximum radial spacing.

40. The furniture drive of claim 39, wherein said control cam has an at least partially spiral configuration.

41. The furniture drive of claim 39, wherein said roller is configured to change, during a course of operation of said control cam, a rate at which said radial spacing of said surface increases.

42. The furniture drive of claim 39, wherein said roller is configured so that said radial spacing of said surface increases in a first region from a minimum value to a maximum value, and so that said radial spacing remains substantially constant in a second region following said first region.

43. The furniture drive of claim 37, wherein said roller is configured so that said radial spacing of said surface increases in a first region from a minimum value to a maximum value and so that said radial spacing remains substantially constant in a second region following said first region.

44. The furniture drive of claim 37, wherein said control cam is located at a peripheral axial surface of said roller.

45. The furniture drive of claim 37, wherein said control cam comprises a first control cam, said roller having two separate control cams including said first control cam and a second control cam.

46. The furniture drive of claim 45, wherein said radial spacing of said two separate control cams changes in opposite relationship.

47. The furniture drive of claim 45, wherein said two separate control cams are located at opposite axial ends of said roller.

48. The furniture drive of claim 37, wherein said force transmission member comprises one of a cable and a belt.

49. A drawer extension guide comprising:

a carcass rail;

a drawer rail; and said furniture drive of claim 37 for driving at least one of said carcass rail and said drawer rail.

* * * * *

UNITED STATES PATENT AND TRADEMARK OFFICE

CERTIFICATE OF CORRECTION

PATENT NO. : 8,324,842 B2
APPLICATION NO. : 12/871065
DATED : December 4, 2012
INVENTOR(S) : Ingo Gasser It is certified that error appears in the above-identified patent and that said Letters Patent is hereby corrected as shown below:

On the Title Page;

In item (75), "Ingo Gasser, Höchst (AT)" should read as follows:

-- Ingo Gasser, Höchst (AT); and

Violand Wilfried, Gaiβau (AT) --

Signed and Sealed this
Ninth Day of June, 2015

Michelle K. Lee

Michelle K. Lee
*Director of the United States Patent and Trademark Office*